US011536069B2

(12) United States Patent
Kohlweiss et al.

(10) Patent No.: US 11,536,069 B2
(45) Date of Patent: Dec. 27, 2022

(54) EJECTING DEVICE FOR A FOLDING DOOR

(71) Applicant: Julius Blum GmbH, Hoechst (AT)

(72) Inventors: Franz Kohlweiss, Hard (AT); Matthias Rupp, Hohenweiler (AT); Dominik Gabl, Bludenz (AT)

(73) Assignee: JULIUS BLUM GMBH, Hoechst (AT)

( * ) Notice: Subject to any disclaimer, the term of this patent is extended or adjusted under 35 U.S.C. 154(b) by 574 days.

(21) Appl. No.: 16/670,306

(22) Filed: Oct. 31, 2019

(65) Prior Publication Data

US 2020/0063482 A1 Feb. 27, 2020

Related U.S. Application Data

(63) Continuation of application No. PCT/AT2018/000041, filed on May 4, 2018.

(30) Foreign Application Priority Data

May 11, 2017 (AT) ..... A 50393/2017

(51) Int. Cl.
*E05F 1/10* (2006.01)
*E05D 15/26* (2006.01)
(Continued)

(52) U.S. Cl.
CPC ..... *E05F 1/10* (2013.01); *E05D 15/264* (2013.01); *E05D 15/58* (2013.01); *E06B 3/482* (2013.01); *E05Y 2900/20* (2013.01)

(58) Field of Classification Search
CPC ..... E06B 3/482; E06B 3/5045; E06B 3/481; E05Y 2900/20; E05Y 2900/212;
(Continued)

(56) References Cited

U.S. PATENT DOCUMENTS 3,275,064 A * 9/1966 Hansen ..... E05D 15/264 160/206
5,131,449 A * 7/1992 Winn ..... E05D 15/264 160/214

(Continued)

FOREIGN PATENT DOCUMENTS

DE 299 10 393 10/1999
DE 20 2018 100 241 3/2018

(Continued)

OTHER PUBLICATIONS

International Search Report dated Aug. 22, 2018 in International (PCT) Application No. PCT/AT2018/000041.

(Continued)

*Primary Examiner* — Justin B Rephann
(74) *Attorney, Agent, or Firm* — Wenderoth, Lind & Ponack, L.L.P.

(57) ABSTRACT

An ejecting device for a folding door is movably arranged on a furniture body. First and second door leaves of the folding door are interconnected in an articulated manner. The ejecting device has an ejecting element for folding open the folding door from a closed position, in which the door leaves are in a common closed plane, into an open position, in which the door leaves form an angle not equal to 180°. The ejecting device has a first fitting part for mounting the ejecting device on the first door leaf. The ejecting element can move the second door leaf from the closed position into the open position by a scissor mechanism having at least two scissor levers, and is mounted between the first and second door leaves by an articulated connection formed by an intermediate lever connected in an articulated manner to the first and/or second scissor lever.

20 Claims, 5 Drawing Sheets

(51) Int. Cl.
*E06B 3/48* (2006.01)
*E05D 15/58* (2006.01)

(58) Field of Classification Search
CPC ..... E05D 15/264; E05D 15/58; E05D 15/26; E05D 2015/586; E05F 1/10; E05F 1/105; E05F 1/1253
See application file for complete search history.

(56) References Cited

U.S. PATENT DOCUMENTS

| | | | | |
|---|---|---|---|---|
| 8,096,341 | B2 * | 1/2012 | Teunissen | E05F 15/605 160/199 |
| 9,068,386 | B2 * | 6/2015 | Ishii | E05D 15/58 |
| 9,284,761 | B2 * | 3/2016 | Haab | E05D 13/00 |
| 9,428,950 | B2 * | 8/2016 | Braungart | E05D 15/264 |
| 10,227,806 | B2 * | 3/2019 | Gabi | E05F 1/16 |
| 10,316,565 | B2 * | 6/2019 | Gabi | E05D 15/58 |
| 10,753,133 | B2 * | 8/2020 | Kohlweiss | E05F 1/1041 |
| 2009/0241288 | A1 | 10/2009 | Zetti | |
| 2013/0228292 | A1 * | 9/2013 | Lucas | E05D 15/0686 160/195 |
| 2014/0150208 | A1 * | 6/2014 | Haab | E05D 15/58 16/86.2 |
| 2015/0084492 | A1 * | 3/2015 | Braungart | E05F 1/105 312/319.2 |
| 2018/0119470 | A1 * | 5/2018 | Kohlweiss | E05D 15/58 |

FOREIGN PATENT DOCUMENTS

| | | |
|---|---|---|
| JP | 07-32165 | 6/1995 |
| JP | 2011-162994 | 8/2011 |
| JP | 2012-1916 | 1/2012 |
| JP | 2014-29103 | 2/2014 |
| WO | 2017/000006 | 1/2017 |

OTHER PUBLICATIONS

English translation of Search Report dated Mar. 26, 2019 in Taiwanese Application No. 107115025.

* cited by examiner

EJECTING DEVICE FOR A FOLDING DOOR

BACKGROUND OF THE INVENTION

The invention concerns an ejecting device and an article of furniture having the ejecting device. Such ejecting devices, also referred to as unfolding aids, are already known and are disclosed, for example, in Austrian patent application A 50049/2017, JP 2014 029 103 A, JP 2012 001 916 A and WO 2017 000006 A1. Those ejecting devices are required as an unfolding aid in order to move folding doors which can also be in the form of folding-sliding doors from the closed position thereof into an open position. In that case the user of the folding door or folding-sliding door does not have to automatically implement the entire movement of the folding door or folding-sliding door from the closed position into the open position. For example, by overpressing the folding door or folding-sliding door which is in the closed position in the direction of the body of the article of furniture which is disposed behind same the ejecting device is activated and ejection of the folding door or folding-sliding door out of the closed position in the direction of the open position is effected.

Accordingly, the ejecting device is viewed as an unfolding aid which is arranged between the door leaves. As the ejecting device is arranged in the invisible region behind the door leaves and the door leaves have to move from the closed position into the open position, only a small amount of space is available, in which the ejecting device can be arranged. As the door leaves which are moveable relative to each other are displaceable from a coplanar position (closed position) into a substantially parallel position (open position) and as in that parallel position there is only still little space between the mutually relatively moveably arranged door leaves, pockets have to be incorporated into the door leaves in the state of the art in order to be able to fit the moveable components of the ejecting device as soon as the ejecting device has to compensate for the movement of the door leaves between the open position and the closed position. The pivotal levers which are necessary for the unfolding aid and which move the door leaves relative to each other have sufficient space in the closed position between the door leaves. However as soon as the door leaves move in the direction of the parallel position or are substantially disposed in the parallel position those pivotal levers have to be disposed in collision-free relationship in the limited space between the door leaves. A parallel position would not be possible in the event of a collision occurring. Accordingly, even a compact arrangement of the door leaves when moved into the open position would not be guaranteed in order for example to be able to conceal them in a retraction compartment. The necessary recesses in the door leaves for concealment of the pivotal levers have to be produced by a production process like for example milling or cutting-out, at the location required for them. That involves an additional working operation and is reflected in an increased amount of work and higher production costs. In addition the door leaf is weakened in terms of its strength of material at the location of the milled-out recess, and over a prolonged period of time that could result in damage at that location on the folding door. In addition the material strength of the door leaves must be sufficiently great in order to be able to produce the pockets at all; a thin-wall folding door can therefore not be used.

SUMMARY OF THE INVENTION

The object of the invention is to avoid the above-described disadvantages and to provide an ejecting device which is improved over the state of the art.

In addition there is provided an article of furniture which is improved over the state of the art, having such an ejecting device.

If the at least one ejecting element for movement of the second door leaf from the closed position into the open position is provided by at least one scissor mechanism, wherein the scissor mechanism is mounted in such a way that it can be folded together between the first and the second door leaves, no openings like for example pockets or recesses are required in the door leaves in order to provide the space for the levers which are to be pivoted in, or for the further moveable component parts of the ejecting device, such space being required upon displacement into the closed position. The scissor mechanism can independently compensate for the movements and is folded together in itself between the door leaves. Accordingly there is provided an ejecting device which in the parallel position (open position) of the door leaves has space in a compact arrangement between the door leaves which are moveable relative to each other. The construction of the individual levers is independent of the dimensions of the door leaves. Accordingly for example it is also possible to use thinner materials on the door leaves as the recesses in the door leaves are no longer necessary.

If the scissor mechanism is formed from at least one first scissor lever and one second scissor lever, wherein the first and the second scissor levers are connected together—preferably in a central region—by way of a hinged connection, two scissor levers are available, which can carry the forces upon opening and closing of the folding door. In addition this provides that for example a scissor lever can be driven, which can automatically bring about the movement of the second scissor lever. This generates a compact drive system to be able to assist with an unfolding movement of the folding door. The forces involved are also better distributed to a plurality of scissor levers, which leads to the system being of a more stable structure.

If the hinged connection is provided by at least one intermediate lever a virtual pivot point is provided on the scissor mechanism. The intermediate lever provides a still more compact structure with better force transmission than in the case of a simple hinge. By virtue of the fact that the pivot point is virtual it can move upon opening and upon closing of the folding door. In that respect it is provided that the intermediate lever is hingedly connected to the first scissor lever and/or the second scissor lever. The hinged connection of the intermediate lever to the first and/or the second scissor lever provides that the force upon opening and closing of the door leaves is transmitted by way of the hinged connection. In addition the door leaves are positioned relative to each other and mounted in a stable state.

If the first scissor lever is mounted at a first end displaceably along a guide device on the first fitment and a second end of the first scissor lever is hingedly connected to a second fitment, then the first scissor lever can move along the guide device upon opening and closing of the folding door, which is reflected in a compact structure. The guide device provides a part of the degrees of freedom that the scissor mechanism requires in order to be able to cause the door leaves to be folded together upon displacement between the open and the closed position.

If the second scissor lever can be brought into contact by a contact portion with a control cam arranged on the first fitment the contact portion can then be displaced along the control cam as soon as the scissor mechanism is in the appropriate position. By virtue of the contact between the contact portion and the control cam a pivotal movement of the second scissor lever can be implemented, wherein by virtue of the pivotal movement of the second scissor lever the first scissor lever can also be entrained because of the hinged connection between the scissor levers. Therefore, the control cam not only moves the scissor mechanism but also affords the degrees of freedom that the scissor mechanism requires for folding the door leaves together and unfolding them. It is possible by way of the control cam to position the door leaves relative to each other in the desired position. The control cam thus defines the travel of the scissor mechanism and also the travel movement of the door leaves relative to each other.

In that respect, it has been found to be advantageous that a force storage means arranged at the scissor mechanism assists the movement of the scissor mechanism as soon as the folding door is moved out of the closed position into the open position. The force for displacement of the door leaves out of the closed position therefore no longer has to be applied by the user. The user admittedly initiates the movement by for example touching the door or pushing it towards a certain position; opening of the door leaves however is then effected automatically to a certain degree.

In that respect, the folding door can be displaced from the closed position completely into the open position, or however also only as far as a certain region in order then to be subsequently completely opened by the user. Thus, it may be that the folding door is moved for example only over halfway between the closed position and the open position by the ejecting device, and the remaining travel movement into the open position is performed manually by the user. The manual actuation can involve loading the force storage means in order to be able to unload it for example in a fresh opening procedure.

If the force storage means is arranged between the first and second scissor levers and/or between the first and/or second scissor lever and the intermediate lever in working relationship on the fitment, then force is applied directly to the scissor mechanism. In addition the force storage means has a compact structure, which is reflected in the space-saving construction of the ejecting device. In addition the application of force is effected directly and not indirectly by way of further levers or otherwise. Further components are eliminated, which for example can suffer wear or could be damaged. It can be provided that the force storage means is formed by a spring—preferably a compression spring.

If the contact portion of the second scissor lever can be pressed against the control cam by the action of the force storage means, the contact portion being displaceable along the control cam the second scissor lever is moved against the control cam by virtue of the application of force by the force storage means. By virtue of that movement and the contact in relation to the first scissor lever the scissor mechanism is forced to convert that application of force from the force storage means against the control cam and against the first scissor lever into a movement. Conversely, the first storage means is loaded in a certain operative position of the ejecting device by way of a movement of the scissor mechanism against the control cam. Unloading and loading of the force storage means is thus effected by way of the control cam and the contact of the contact portion against the second scissor lever.

If the force storage means is mounted to an end portion of the second scissor lever and urges the contact portion mounted moveably on the second scissor lever—preferably slidably—in a direction opposite to the end portion then the second scissor lever is variable in its length, which results upon a change in length of the second scissor lever in direct conversion of the movement of the scissor mechanism and unloading and loading of the force storage means. If the length of the second scissor lever and/or the length of the force storage means butting against the second scissor lever changes by virtue of the unloading of the force storage means the scissor mechanism is set in operation and generates an assisted movement of the door leaves out of the closed position.

If the control cam has an opening portion and a stressing portion wherein the contact portion—preferably provided by a rolling body mounted rotatably on the second scissor lever—is displaceable on the opening portion and the stressing portion the ejection movement of the scissor mechanism is produced by way of the contact portion which moves along the opening portion of the control cam, in which case the folding door is opened. If the folding door is further moved manually for example by the user then the control cam moves into the stressing portion and by way of the contact portion loads up the force storage means for a further opening procedure.

It has proven to be advantageous in that respect if there is provided a locking device for locking the force storage means, wherein the force storage means can be stressed by the cooperation of the control cam and the contact portion and the force storage means is locked in the stressed state by the locking device, whereby unloading of the force storage means can be prevented. Thus unloading and loading of the force storage means can occur in the context of the relative position as between the contact portion and the control cam. The force storage means can be locked in the loaded state, which prevents automatic unloading thereof. The force storage means can be released and unloaded if the user wants that. Unloading of the force storage means by mistake is excluded.

A release device is provided which, in a release position, unlocks the locking device so that the force storage means can be changed from the loaded to the unloaded state, and therefore opening of the folding door is enforced by way of that release device. That release device can be, for example, a connecting element which at least temporarily connects the ejecting device to another component part of the article of furniture or the furniture carcass as soon as the user for example presses against the folding door. The release device, however, can also be a push button or something comparable which can be directly actuated by the user. It is thus possible for the release device to be mounted to the article of furniture in a concealed position. The release device, however, can also be arranged visibly on the article of furniture.

If the release device upon pressing of the release device is moveable from a substantially coplanar position of the door leaves into the release position that can be arranged in a concealed position on the article of furniture. By pressing against the door leaf and overpressing it beyond its coplanar position the release device is activated and opening of the folding doors is enforced. That is also achieved by the release device, when the release device is pressed towards the furniture carcass, being moveable into the release position.

The concealed position of the release device is also achieved by the at least one locking device, with the ejecting device fitted, being unlockable by the application of pressure to the folding door, preferably in the region in which the door leaves are hingedly connected together.

An article of furniture has been found to be advantageous, which has a furniture carcass, at least one folding door which includes at least two door leaves hingedly connected together, wherein the folding door or folding-sliding door can assume at least a closed position in which the at least two door leaves are arranged in a common closing plane and an open position in which the at least two door leaves include an angle not equal to 180° relative to each other, and at least one ejecting device.

It is advantageous if the at least one ejecting device is arranged at a side, towards the furniture carcass, of one of the two door leaves. This therefore provides for a concealed configuration for the ejecting device. It is arranged non-visibly from the outside of the article of furniture.

It has further been found to be advantageous if the furniture carcass has a retraction compartment provided by a cavity for receiving the at least one folding door in a folded-together retraction position. In that way the folding door which has been moved into the open position can be retracted laterally on the furniture carcass and does not project into the room. This therefore provides a space-saving article of furniture, the folding door of which is always stowed away and is not in the way.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1A:
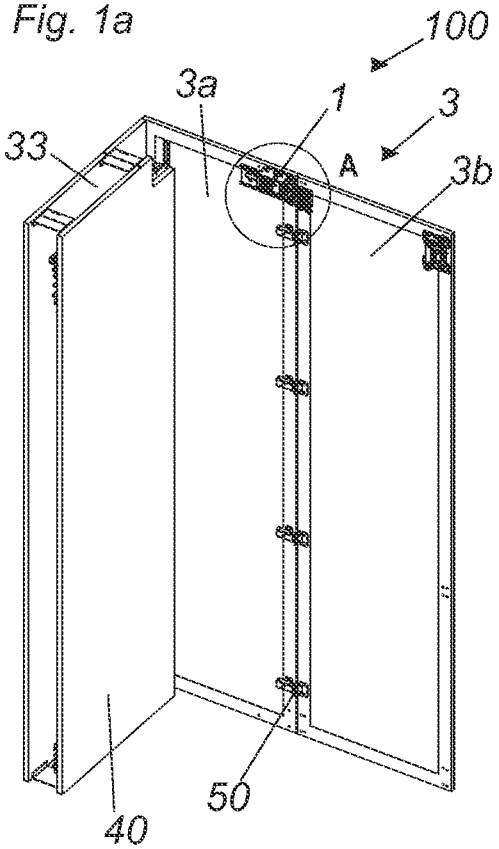
FIG. 1*a* shows an article of furniture with a retraction compartment and a folding door.

FIG. 1*a* shows the article of furniture 100 with a retraction compartment 33 which is arranged laterally on the article of furniture 100 and in which the folding door 3 can be stowed by being pushed therein with the door leaves 3*a*, 3*b* in the folded-together state. FIG. 1*a* shows the closed position of the folding door 3. The folding door 3 can also be in the form of a folding-sliding door, as shown in FIG. 1*a*. For that purpose it is fastened at the upper edge and/or the lower edge of the folding door 3 by a longitudinal guide (not visible in FIG. 1*a*). Besides the ejecting device 1 at the door gap between the door leaves 3*a*, 3*b* hinges 50 are also arranged at the gap in order to permit pivotal movement of the door leaves 3*a*, 3*b* between an open position and a closed position. The retraction compartment 33 is provided by the furniture carcass 40 or is arranged thereon. A part which is not visible of the furniture carcass 40 extends parallel to the ejecting device 1 in order if necessary to make contact with respect to the ejecting device 1. That component part of the furniture carcass 40 can be for example a shelf, a cover panel or another component part of the furniture carcass 40.

Figure 1B:
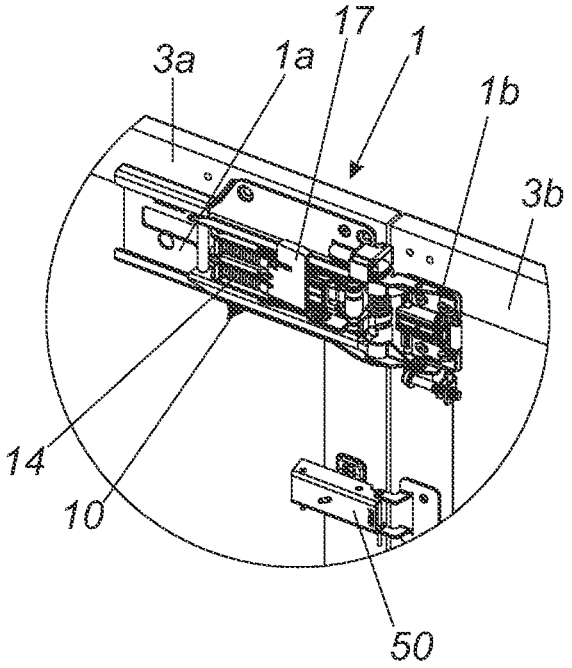
FIG. 1*b* shows an ejecting device on the folding door.

FIG. 1*b* shows the ejecting device 1 of FIG. 1*a* in detail. The release device 17 which is arranged moveably on the ejecting device 1 comes into contact if required with a component part of the furniture carcass 40. For reasons of simplification the furniture carcass 40 has not been shown in FIG. 1*b*. The release device 17 is in the form of a contact member which, upon overpressing of the door leaves 3*a*, 3*b* from the coplanar position shown in FIG. 1*b* towards a component part of the furniture carcass, comes into contact with the furniture carcass 40 and thereupon releases same. Accordingly the ejecting device is set in operation and the movement of the door leaves 3*a*, 3*b* relative to each other begins. In that case the ejecting device 1 has a first fitment la and a second fitment 1*b*. The scissor mechanism 10 connects the first and the second fitments 1*a*, 1*b*. Upon release by the release device 17 the scissor mechanism 10 is set in motion by at least one force storage means 14, and this results in opening of the door leaves 3*a*, 3*b*.

Figure 2:
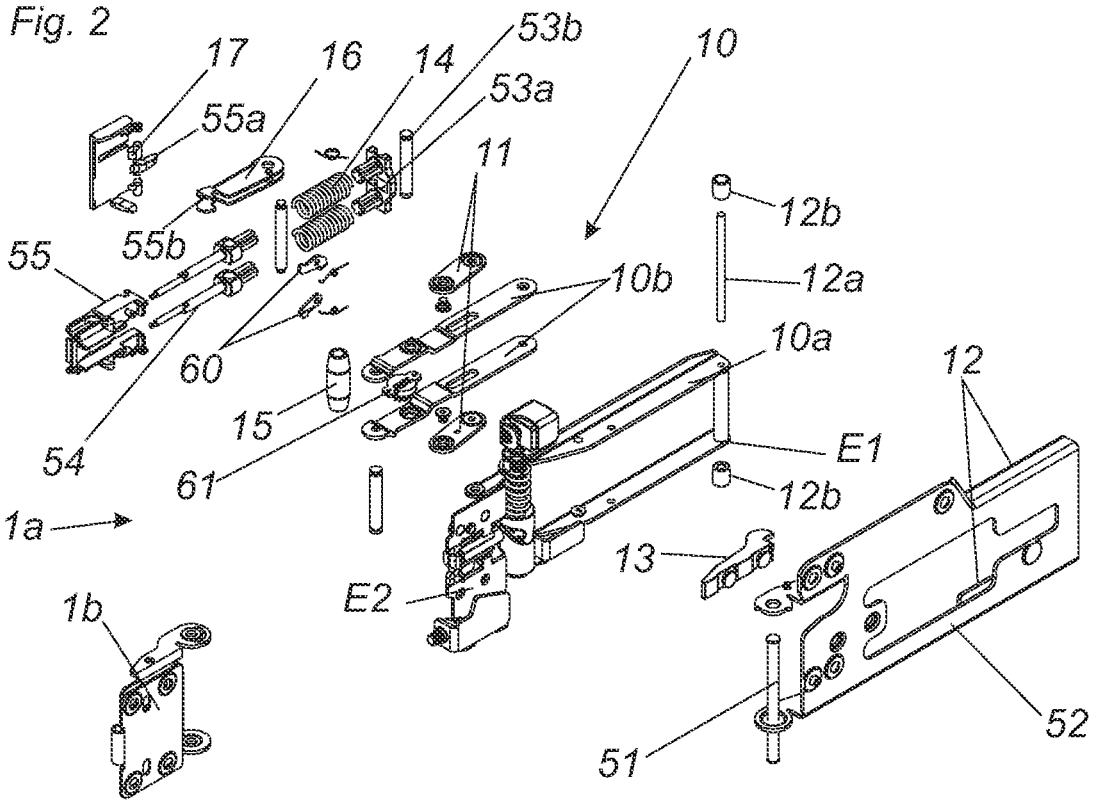
FIG. 2 is an exploded view of the ejecting device.

FIG. 2 shows an exploded view of the ejecting device 1 comprising a first fitment 1*a* and a second fitment 1*b*. The majority of the individual component parts are disposed on the first fitment 1*a*. That includes a base element 52 which is connected to the first door leaf 3*a* by way of fixing portions. It can be connected to the first door leaf 3*a* for example by way of screws or similar fixing means. For simplification reasons that is not shown in FIG. 2.

Disposed on the base element 52 is at least one guide device 12 for receiving the guide elements 12*b* which are disposed on the first scissor lever 10*a* and which are arranged at a first end E1 of the first scissor lever 10*a*. The second end E2 of that first scissor lever 10*a* is connected to the second fitment 1*b*. The guide elements 12*b* are rotatably connected to the first scissor lever by way of a pin 12*a* and are displaceable along the guide device 12 on the base element 52.

The first scissor lever 10*a* is connected to the second scissor lever 10*b* by way of at least one intermediate lever 11. The second scissor lever has a contact portion 15 which can be brought into contact with the control cam 13 on the base element 52. Accordingly the contact portion 15—in the form of a rolling body—is supported at least at times at the control cam 13. Disposed at the opposite end of the second scissor lever 10*b* is the mounting 53*a* which is mounted by way of a bolt 53*b* at at least one force storage means 14 on the second scissor lever 10*b*. The force storage means 14 act by way of a displacement device 54 against a carriage 55. The carriage 55 additionally serves to receive the contact portion 15. When the contact portion 15 is moved by the control cam 13 those movements are transmitted by the carriage 55 to the force storage means 14 and vice-versa. The locking device 16 is provided for locking the carriage 55. The device 16 is mounted rotatably to the second scissor lever 10*b* by way of the bolt 53*b*. Release or triggering of the locking device 16 is effected by way of the release device 17 which is also mounted moveably to the second scissor lever 10*b*. In this case a corresponding recess 55*b* on the locking device 16 is connected by way of a projection 55*a*.

A push-through prevention arrangement 60 which is operatively connected to a control device 61 prevents premature triggering of the ejecting device 1 occurring. If for example the opening process for opening the door from the closed position to the open position is interrupted by the user and the folding door is pushed back into the coplanar position renewed ejection of the folding door 3 could occur. That is prevented by the arrangement 60 and the control device 61. The prevention arrangement in that case is connected to the carriage 55 and then releases it only as soon as regular opening of the door was intended to take place.

Figure 3A:
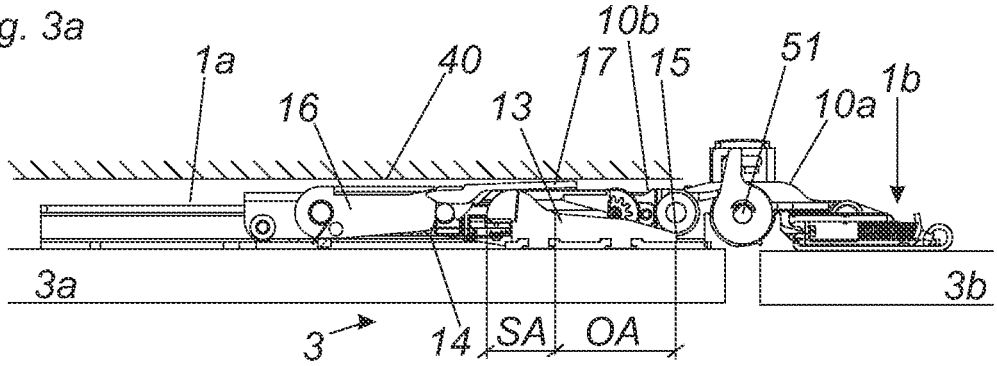
FIGS. 3*a* and 3*b* show the closed position of the folding door.

FIG. 3*a* shows the closed position of the folding door, with the door leaves 3*a*, 3*b* being in a coplanar position with respect to each other. The force storage means 14 disposed behind the locking device 16 is stressed. The release device 17 is spaced relative to the furniture carcass 40. The locking device 16 is thus also in the locked state. The force storage means 14 cannot be unloaded. Accordingly the contact portion 15 of the second scissor lever 10*b* is also at the beginning of the control cam 13. The position of the contact portion 15 relative to the control cam 13 is maintained by virtue of the locked force storage means 14 at the beginning of the opening portion OA. The opening portion OA extends over at least half the travel distance of the control cam 13 and goes into the stressing portion SA.

Figure 3B:
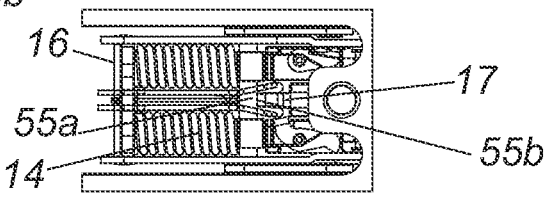

FIG. 3*b* shows a view from below of the release device 17 which is in engagement by way of the projection 55*b* with the corresponding recess 55*a*. The recess 55*a* is disposed on the locking device 16. The locking device 16 holds the force storage means 14 in the stressed position.

Figure 4:
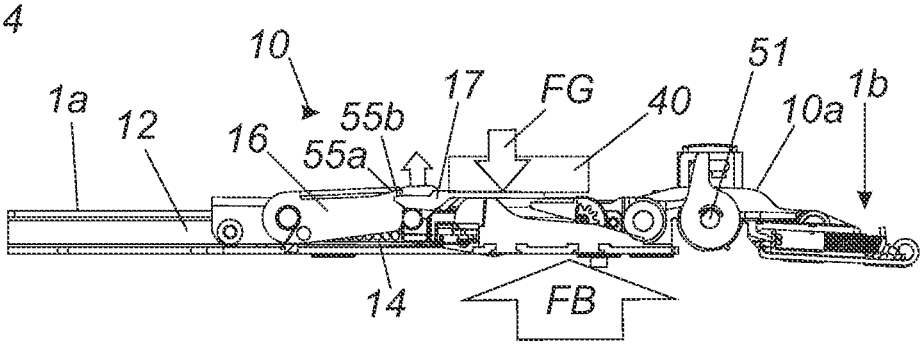
FIGS. 4-7 show different views and positions of the ejecting device upon unloading of the at least one force storage means and displacement in the direction of the open position.

FIG. 4 shows release of the release device 17. The force FB applied by the user acts against the door leaves 3*a*, 3*b* (not shown in FIG. 4). By virtue of overstretching from the coplanar position the release device 17 is pressed against a component part of the furniture carcass 40. A counteracting force FG is produced at the release device 17 by the force of the user FB. Accordingly the extension portion 55*b* of the release device is pulled out of the recess 55*a* of the locking device 16. The locking device 16 is now in the unlocked state. As shown in FIG. 4 that can be effected by a component part of the furniture carcass 40.

Also however by for example a direct or indirect connection between the release device 17 and for example the second door leaf 3*b* or the second fitment 1*b*. That connection can be for example a tensioned Bowden cable or a similar device which upon overpressing of the door leaves out of the coplanar position effects release of the release device 17. Thus it is not always necessary to implement a direct contact in relation to the furniture carcass 40 to ensure release of the release device 17. There is also the option of effecting release by way of a connection of the release device 17 to a region of the ejecting device 1, that is moveable relative thereto.

Figure 5:
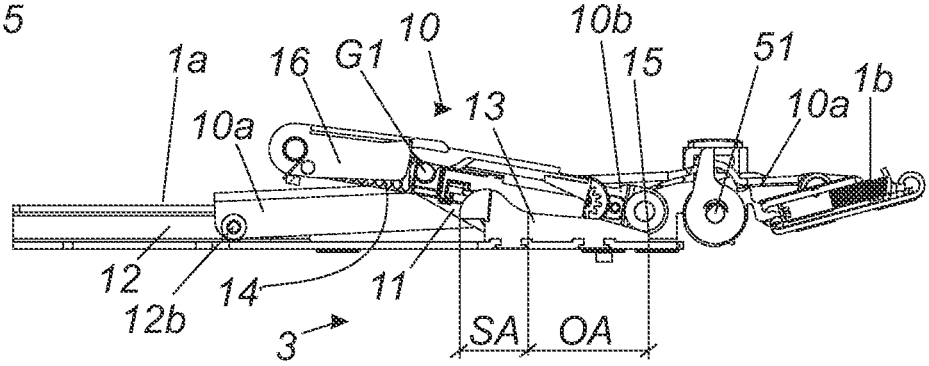

FIG. 5 shows an unlocked locking device 16. The force storage means 14 now acts against the contact portion 15, wherein the latter is moved along the opening portion OA of the control cam 13 and the scissor mechanism 10 is also set in motion by the connection in relation to the intermediate lever 11. In that case the second scissor lever 10*b* moves the first scissor lever 10*a* by way of the intermediate lever 11 which is fixed at the hinge point G1 on the second scissor lever 10*b*. The first scissor lever 10*a* is connected to the guide device 12 at the first fitment 1*a* by way of a guide element 12*b*. Accordingly the ejecting device 1 is moved out of the coplanar position in the direction of the open position by way of the force storage means 14, the hinge point G1, the intermediate lever 11 and the first scissor lever 10*a*. The movement takes place about the axis of rotation 51.

Figure 6:
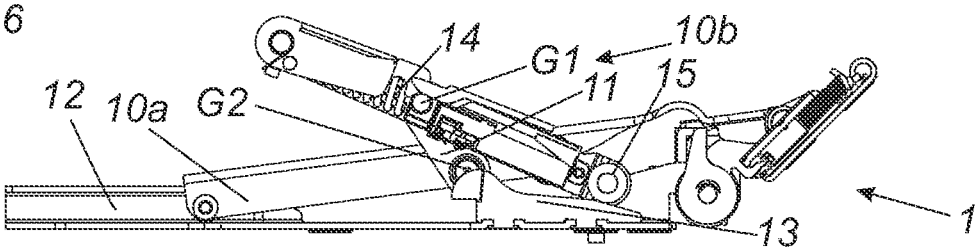

FIG. 6 shows a further position between the closed position and the open position of the ejecting device 1. The force storage means 14 is further unloaded, the second scissor lever 10*b* moves the first scissor lever 10*a* along the guide device 12 by way of the first hinge point G1 and the second hinge point G2 and the intermediate lever arranged therebetween. In that case the contact portion 15 moves along the control cam 13. The scissor mechanism 10 is thus supported by the base body 6.

Figure 7:
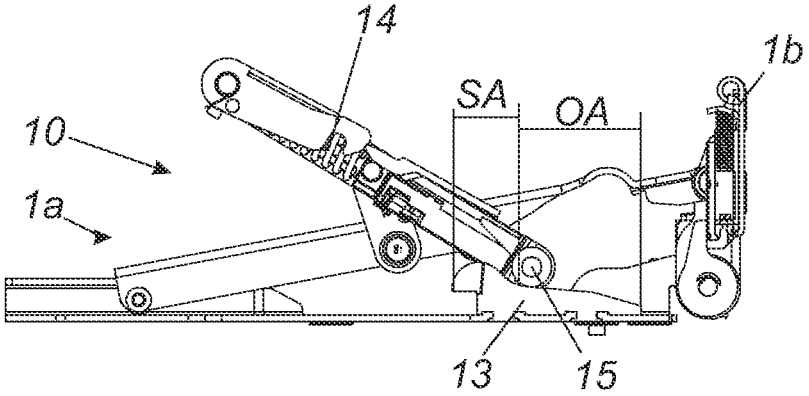

FIG. 7 shows an opening angle of about 90° of the ejecting device 1. For reasons of simplification the first and second door leaves 3*a* and 3*b* have not been shown, the angle of these would now also correspond to about 90° relative to each other. The force storage means 14 is further unloaded until the contact portion 15 has arrived at the end of the opening portion OA of the control cam 13. When the contact portion 15 is at the end of the opening portion OA and thus at the transition of the stressing portion SA the force storage means 14 is completely unloaded.

The scissor mechanism 10 thereupon no longer moves further automatically by virtue of the force influence of the force storage means 14. A further movement out of that position into the completely open position of the ejecting device 1 can be effected for example by way of a furniture drive or now also manually by the user.

Figure 8:
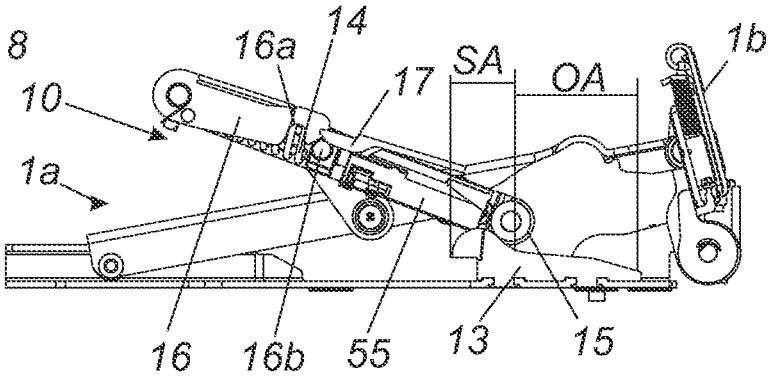
FIGS. 8-11 show different views and positions of the ejecting device upon loading of the at least one force storage means and displacement in the direction of the open position.

FIG. 8 shows how the scissor mechanism 10 behaves when the second fitment 1*b* is further pivoted to load the force storage means 14. Loading of the force storage means 14 is effected by way of the contact portion 15 which is now in the stressing portion SA. The angle between the first fitment 1*a* and the second fitment 1*b* is further reduced by a furniture drive or manual actuation by the user. The contact portion 15 is moved along the stressing portion SA at the control cam 13 in positively guided relationship, which leads to stressing of the force storage means 14. In parallel therewith the scissor mechanism 10 can be further displaced in order to move the door leaves 3*a*, 3*b* (not shown in FIG. 8 for reasons of simplification) into their open position (parallel position). In that case stressing of the force storage means 14 is effected by way of the carriage 55 connected to the contact portion 15. By virtue of the contact of the contact portion with the control cam 13 the carriage now moves against the adjusting force of the force storage means 14. It is also apparent how the locking device 16 approaches the corresponding locking portion 16*b*, with the locking portion 16*a* of the device 16. In this case the locking portion 16*a* and the corresponding locking portion 16*b* are afforded by a positively locking connection, for example by a notch with a pin.

Figure 9:
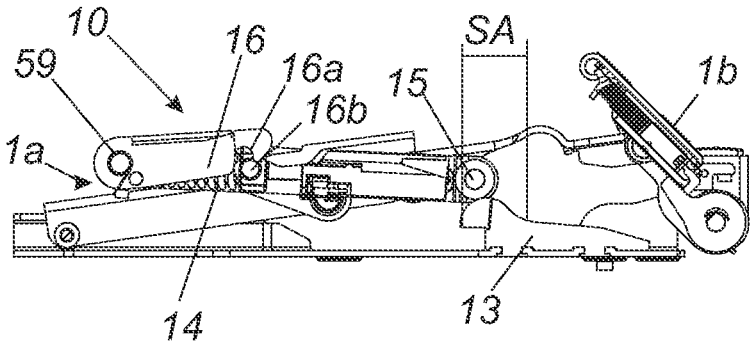

FIG. 9 shows how the folding door 3 (not visible in FIG. 9) is moved further in the direction of the open position. The contact portion 15 is shortly before the most strongly pronounced region of the control cam 13 in the stressing portion. The force storage means 14 is thus shortly before its most heavily stressed position. The locking device 16 is shortly before the locking point. The scissor mechanism 10 is further folded together and takes its place between the door leaves 3*a*, 3*b* (not visible in the Figure). A small spring 59 in the pivotal region of the locking device 16 urges same as a primary matter into the locking position in order to ensure secure latching as soon as the locking portions 16*a*, 16*b* bear over or into each other in positively locking relationship.

Figure 10:
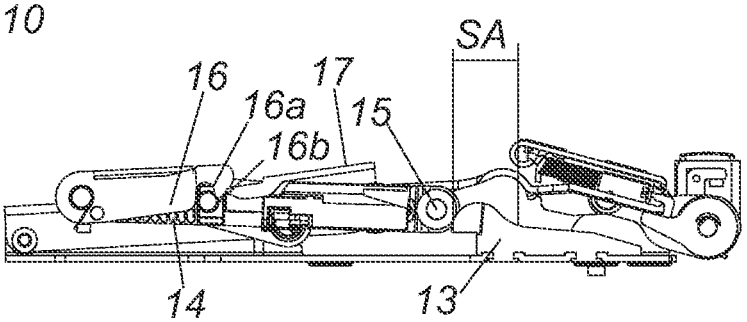

FIG. 10 shows the ejecting device 1 shortly before the open position which substantially corresponds to the parallel position of the folding door 3 (not visible in FIG. 10). The contact portion has arrived shortly before the end of the stressing portion SA of the control cam 13. The force storage means 14 is almost completely stressed. By virtue of the fact that the locking device 16 has moved away from the release device 17 along the longitudinal axis of the force storage means no release can now take place in the parallel position of the door leaves 3*a*, 3*b*. Accordingly there is no contact of the release device 17 with the locking device 16 in the parallel position of the door leaves 3*a*, 3*b* as unlocking of the force storage means 14 in the open position is not wanted.

Figure 11:
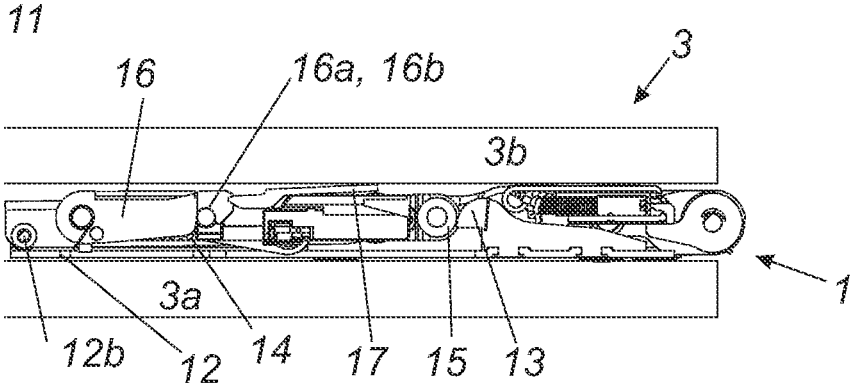

FIG. 11 shows the parallel position of the folding door 3. The parallel position corresponds to the open position of the folding door 3 in which the first door leaf 3*a* is disposed relative to the second door leaf 3*b* substantially in a parallel position. The ejecting device 1 is now disposed in the folded-together state between the door leaves 3*a*, 3*b*. In this case the force storage means 14 is completely stressed. The locking device 16 is closed by virtue of the corresponding locking portions 16*a*, 16*b*.

By virtue of the removal of the release device 17 in relation to the locking device 16 release is not possible in the open position of the folding door 3. The contact portion 15 is disposed in the end position on the control cam 13. In that open position the folding door can be inserted into the retraction compartment 33 shown in FIG. 1. Such insertion into the retraction compartment 33 can be effected by way of a drive or also by the force of the user. Removal from the retraction compartment 33 can also be effected by way of a drive. Accordingly the folding door 3 moved into the open position is ejected from the retraction compartment 33 and can be moved into the closed position again by way of an additional drive or also manually by the user.

In the movement from the open position into the closed position the ejecting device 1 is virtually in an idle mode and is moved in the stressed state from the open position into the closed position to be able to ensure renewed release. In the entirely folded-together state of the ejecting device 1 the guide element 12*b* is disposed at the end of the guide device 12.

Figure 12:
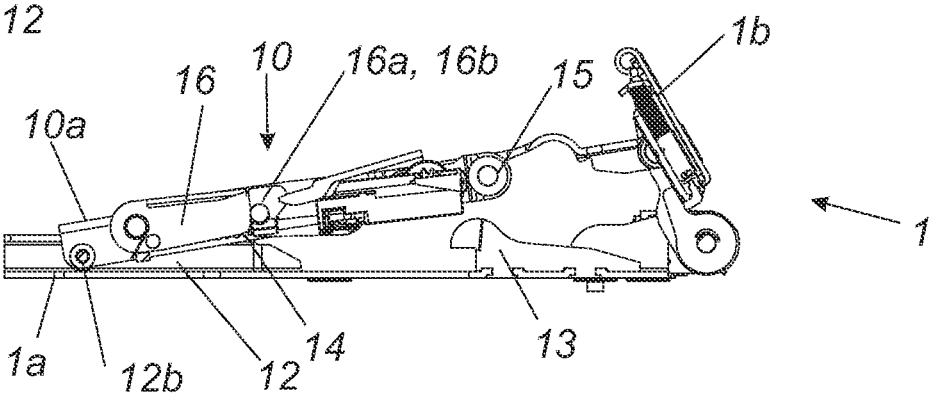
FIGS. 12-15 show different views and positions of the ejecting device in the return movement in the direction of the closed position.

FIG. 12 shows the ejecting device 1 on pivoting back from the open position into the closed position. In this case the guide element 12*b* of the first scissor lever 10*a* is moved along the guide device 12. The scissor mechanism 10 then remains in the folded-together state as it is latched by the locking device 16. The locking device 16 remains closed by way of the locking portions 16*a*, 16*b*. The force storage means 14 remains loaded. The contact portion 15 moves away from the control cam 13. There is no contact between the contact portion 15 and the control cam 13.

Figure 13:
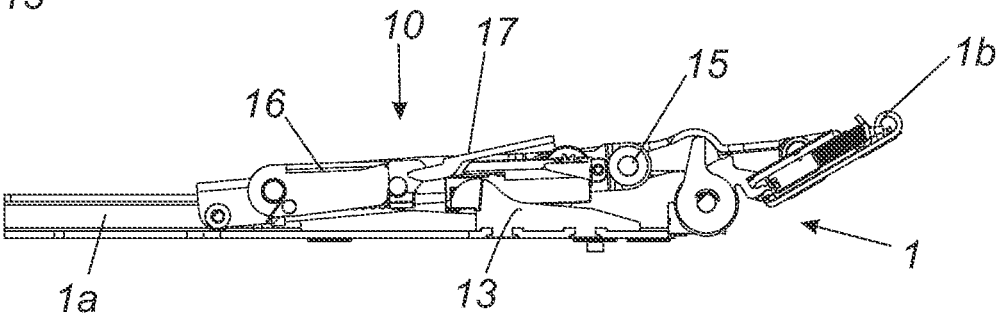

FIG. 13 shows the ejecting device 1 shortly before the coplanar position (closed position) of the door leaves 3*a*, 3*b*. In this case the scissor mechanism 10 is still in the folded-together state. It will be seen that the release device 17 moves closer to the locking device 16 in order to be able to ensure release again in the coplanar position. The contact portion 15 is moved away in spaced relationship with the control cam 13 and does not come into engagement therewith.

Figure 14:
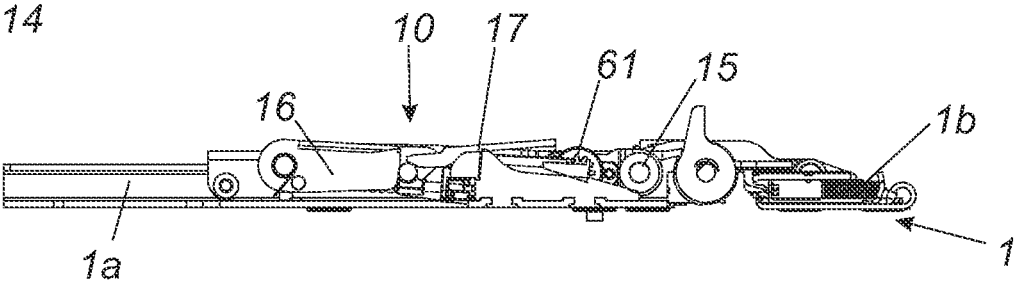

FIG. 14 shows the ejecting device 1 in the coplanar position of the folding door 3. It is striking that the release device 17 is not yet in engagement with the locking device 16. Renewed release is therefore not yet possible. That is effected by virtue of the push-through protection arrangement which intended to prevent the door being immediately opened again by the closing movement and by moving beyond the coplanar position. A time delay in respect of engagement of the release device 17 into the locking device 16 is therefore to occur. That is effected by way of the control device 61 which causes time-delayed adjustment of the release device 17. The control device 61 can be for example in the form of a damper, rotary damper or the like. For re-adjustment of the release device 17 that requires longer than the closing movement of the door leaf 3.

Figure 15:
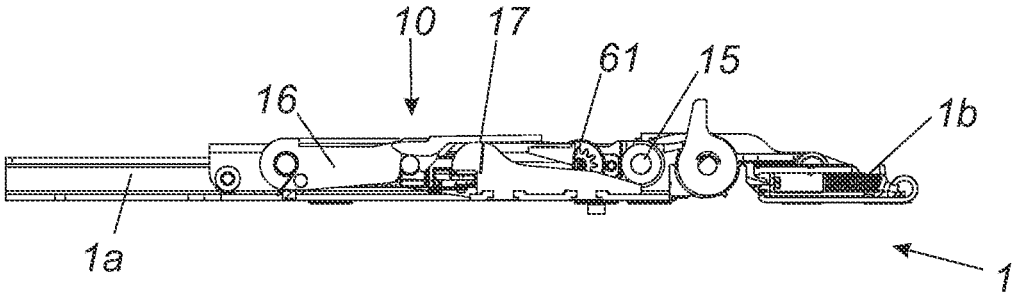

FIG. 15 shows how the push-through protection arrangement has been canceled by way of the control device 61. The release device 17 was correspondingly brought into engagement with the locking device 16 in order to be able to ensure fresh release of the ejecting device. Fresh release begins as soon as pushing through beyond the coplanar position of the door leaves 3*a*, 3*b* is effected, as shown in FIG. 4.

The invention claimed is:

1. An ejecting device for a folding door arranged moveably on a furniture carcass, wherein the folding door includes a first door leaf and a second door leaf that are hingedly connected together, the ejecting device comprising:

an ejecting element for unfolding the folding door from a closed position, in which the first and second door leaves are arranged in a common closing plane, into an open position in which the first and second door leaves include an angle not equal to 180° relative to each other; and a first fitment for mounting the ejecting device to the first door leaf, the ejecting element being supported at the first fitment, wherein the ejecting element is adapted to move the second door leaf from the closed position into the open position by a scissor mechanism, wherein the scissor mechanism has a first scissor lever and a second scissor lever, and is mounted by way of a hinged connection such that the scissor mechanism can be folded together between the first and second door leaves, wherein the hinged connection is formed by an intermediate lever hingedly connected to the first scissor lever and the second scissor lever, wherein a force storage means is arranged at the scissor mechanism and is configured to assist movement of the scissor mechanism as soon as the folding door is moved out of the closed position into the open position, and wherein the second scissor lever has a contact portion which can be pressed against a control cam arranged on the first fitment by action of the force storage means, the contact portion being displaceable along the control cam.

2. The ejecting device as set forth in claim 1, wherein the first and the second scissor levers are connected together in a central region by way of the hinged connection.

3. The ejecting device as set forth in claim 1, wherein the first scissor lever is mounted at a first end displaceably along a guide device on the first fitment, and a second end of the first scissor lever is hingedly connected to a second fitment.

4. The ejecting device as set forth in claim 1, wherein a pivotal movement of the second scissor lever can be produced by contact between the contact portion and the control cam, wherein by virtue of the pivotal movement of the second scissor lever, the first scissor lever can also be displaced based on the hinged connection between the first and second scissor levers.

5. The ejecting device as set forth in claim 1, wherein the force storage means is arranged between the first and second scissor levers, or between the intermediate lever and one of the first and second scissor levers, in working relationship on the first fitment.

6. The ejecting device as set forth in claim 1, wherein the force storage means is formed by a spring.

7. The ejecting device as set forth in claim 6, wherein the spring is a compression spring.

8. The ejecting device as set forth in claim 1, wherein the force storage means is mounted to an end portion of the second scissor lever and urges the contact portion mounted moveably on the second scissor lever in a direction opposite to the end portion.

9. The ejecting device as set forth in claim 8, wherein the contact portion is mounted slidably on the second scissor lever.

10. An article of furniture comprising:

a furniture carcass;

a folding door which includes first and second door leaves hingedly connected together, wherein the folding door can assume a closed position in which the first and second door leaves are arranged in a common closing plane and an open position in which the first and second door leaves include an angle not equal to 180° relative to each other; and the ejecting device as set forth in claim 1.

11. The article of furniture as set forth in claim 10, wherein the ejecting device is arranged at a side, towards the furniture carcass, of one of the first and second door leaves.

12. The article of furniture as set forth in claim 10, wherein the furniture carcass has a retraction compartment provided by a cavity for receiving the folding door in a folded-together retraction position.

13. An ejecting device for a folding door arranged moveably on a furniture carcass, wherein the folding door includes a first door leaf and a second door leaf that are hingedly connected together, the ejecting device comprising:

an ejecting element for unfolding the folding door from a closed position, in which the first and second door leaves are arranged in a common closing plane, into an open position in which the first and second door leaves include an angle not equal to 180° relative to each other, and a first fitment for mounting the ejecting device to the first door leaf, the ejecting element being supported at the first fitment, wherein the ejecting element is adapted to move the second door leaf from the closed position into the open position by a scissor mechanism, wherein the scissor mechanism has a first scissor lever and a second scissor lever, and is mounted by way of a hinged connection such that the scissor mechanism can be folded together between the first and second door leaves, wherein the hinged connection is formed by an intermediate lever hingedly connected to the first scissor lever and the second scissor lever, wherein the second scissor lever has a contact portion which can be brought into contact with a control cam arranged on the first fitment, wherein the control cam has an opening portion and a stressing portion, and wherein the contact portion is displaceable along the opening portion and the stressing portion of the control cam.

14. The ejecting device as set forth in claim 13, wherein the contact portion is provided by a rolling body mounted rotatably on the second scissor lever.

15. An ejecting device for a folding door arranged moveably on a furniture carcass, wherein the folding door includes a first door leaf and a second door leaf that are hingedly connected together, the ejecting device comprising:

an ejecting element for unfolding the folding door from a closed position, in which the first and second door leaves are arranged in a common closing plane, into an open position in which the first and second door leaves include an angle not equal to 180° relative to each other; and a first fitment for mounting the ejecting device to the first door leaf, the ejecting element being supported at the first fitment, wherein the ejecting element is adapted to move the second door leaf from the closed position into the open position by a scissor mechanism, wherein the scissor mechanism has a first scissor lever and a second scissor lever, and is mounted by way of a hinged connection such that the scissor mechanism can be folded together between the first and second door leaves, wherein the hinged connection is formed by an intermediate lever hingedly connected to the first scissor lever and the second scissor lever, wherein a force storage means is arranged at the scissor mechanism and is configured to assist movement of the scissor mechanism as soon as the folding door is moved out of the closed position into the open position, wherein the second scissor lever has a contact portion which can be brought into contact with a control cam arranged on the first fitment, wherein the ejecting device further comprises a locking device for locking the force storage means, and wherein the force storage means can be loaded by cooperation of the control cam and the contact portion, and the force storage means can be locked in a loaded state by the locking device, whereby unloading of the force storage means can be prevented.

16. The ejecting device as set forth in claim 15, further comprising a release device which in a release position unlocks the locking device so that the force storage means can be changed from the loaded state to an unloaded state.

17. The ejecting device as set forth in claim 16, wherein the release device, upon pressing of the release device, is moveable from a substantially coplanar position of the first and second door leaves into the release position.

18. The ejecting device as set forth in claim 17, wherein the release device, upon pressing of the release device against the furniture carcass, is moveable into the release position.

19. The ejecting device as set forth in claim 15, wherein when the ejecting device is mounted to the first door leaf, the locking device is unlockable by application of pressure to the folding door.

20. The ejecting device as set forth in claim 19, wherein when the ejecting device is mounted to the first door leaf, the locking device is unlockable by application of pressure to the folding door in a region in which the first and second door leaves are hingedly connected together.

* * * * *